US006619989B1

(12) United States Patent
Yi

(10) Patent No.: US 6,619,989 B1
(45) Date of Patent: Sep. 16, 2003

(54) CABLE CONNECTOR HAVING INTEGRALLY FORMED METAL LATCH AND CABLE STRAIN RELIEF

(75) Inventor: Chong Hun Yi, Mechanicsburg, PA (US)

(73) Assignee: Hon Hai Precision Ind. Co., Ltd., Taipei Hsien (TW)

( * ) Notice: Subject to any disclaimer, the term of this patent is extended or adjusted under 35 U.S.C. 154(b) by 0 days.

(21) Appl. No.: 10/161,465

(22) Filed: May 30, 2002

(51) Int. Cl.[7] ..... H01R 9/03
(52) U.S. Cl. ..... 439/610; 439/354; 439/357
(58) Field of Search ..... 439/610, 350, 439/357, 358, 354, 607

(56) References Cited

U.S. PATENT DOCUMENTS 4,316,647 A * 2/1982 Bailey et al. ..... 439/354
5,387,130 A * 2/1995 Fedder et al. ..... 439/610
5,934,942 A * 8/1999 Patel et al. ..... 439/610
6,186,819 B1 * 2/2001 Holub ..... 439/358
6,257,914 B1 * 7/2001 Comerci et al. ..... 439/357

* cited by examiner

*Primary Examiner*—Hien Vu
(74) *Attorney, Agent, or Firm*—Wei Te Chung

(57) ABSTRACT

A cable connector (1) comprises an insulating housing (10), a plurality of mating portions (16) secured at a first end (12) of the housing, a cable (26) secured to the housing (10) and extending through a second end (14) of the housing and electrically connecting with the mating portions, and a metal piece (34) secured to the housing. The metal piece includes a metal latch (36) and a strain relief (38) integrally formed with the metal latch. The metal latch is secured at a top of the housing to contact a grounding piece of a mating connector. The strain relief is secured around an exposed portion of a cable (26) of the cable connector, and electrically engages with metal braiding (28) of the cable.

2 Claims, 3 Drawing Sheets

CABLE CONNECTOR HAVING INTEGRALLY FORMED METAL LATCH AND CABLE STRAIN RELIEF

BACKGROUND OF THE INVENTION

1. Field of the Invention

The present invention relates to a cable connector, and particularly to a cable connector having integrally formed metal latch and cable strain relief.

2. Description of related Art

A conventional high speed serial data connector (HSSDC) has a metal latch secured to an insulating housing of the connector for latching with a mating connector when the two connectors are mated together, and an insulating cable strain relief around an exposed portion of a cable of the connector to protect connection between the cable and the connector. However, such a conventional connector is costly because the metal latch and the insulating cable strain relief must be manufactured and assembled separately. On the other hand, a grounding path starting from braiding of the cable through a die case shell and the metal latch of the connector to the mating connector is too complicated to provide an effective grounding function. Thus, an improved cable connector which can overcome the disadvantages of the prior art device is desired.

SUMMARY OF THE INVENTION

Accordingly, an object of the present invention is to provide a cable connector having integrally formed metal latch and cable strain relief to decrease the overall cost of the connector and improve the grounding performance.

In order to achieve the object set forth, a cable connector of the present invention comprises an insulating housing, a plurality of mating portions secured to a first end of the housing, and a cable secured at a second end of the housing and electrically connecting with the mating portions. The connector comprises a metal piece having a metal latch and a strain relief integrally formed with the metal latch. The metal latch includes a first crimping portion secured around a portion of the cable to protect the electrical connection between the cable and the mating portions. The strain relief has a second crimping portion engaging with grounding braiding of the cable. A grounding path can be thus established from the cable through the metal piece to a grounding piece of a mating connector.

Other objects, advantages and novel features of the invention will become more apparent from the following detailed description of the preferred embodiment when taken in conjunction with the accompanying drawings.

DETAILED DESCRIPTION OF THE INVENTION

Figure 1:
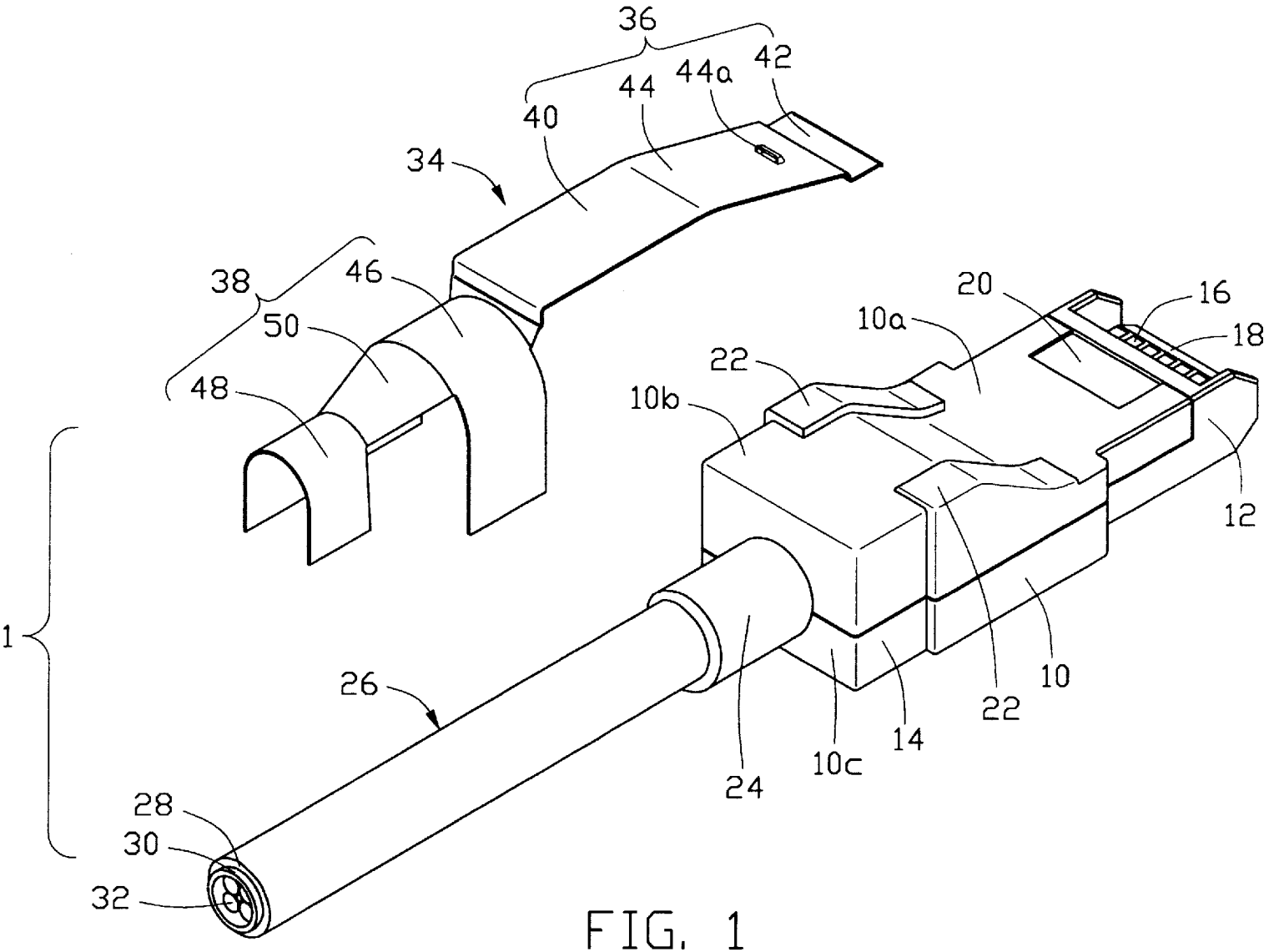
FIG. 1 is a perspective view of a cable connector of the present invention wherein a metal piece is to be assembled to an insulating housing of the connector.

Reference will now be made to the drawing figures to describe the present invention in detail.

Figure 2:
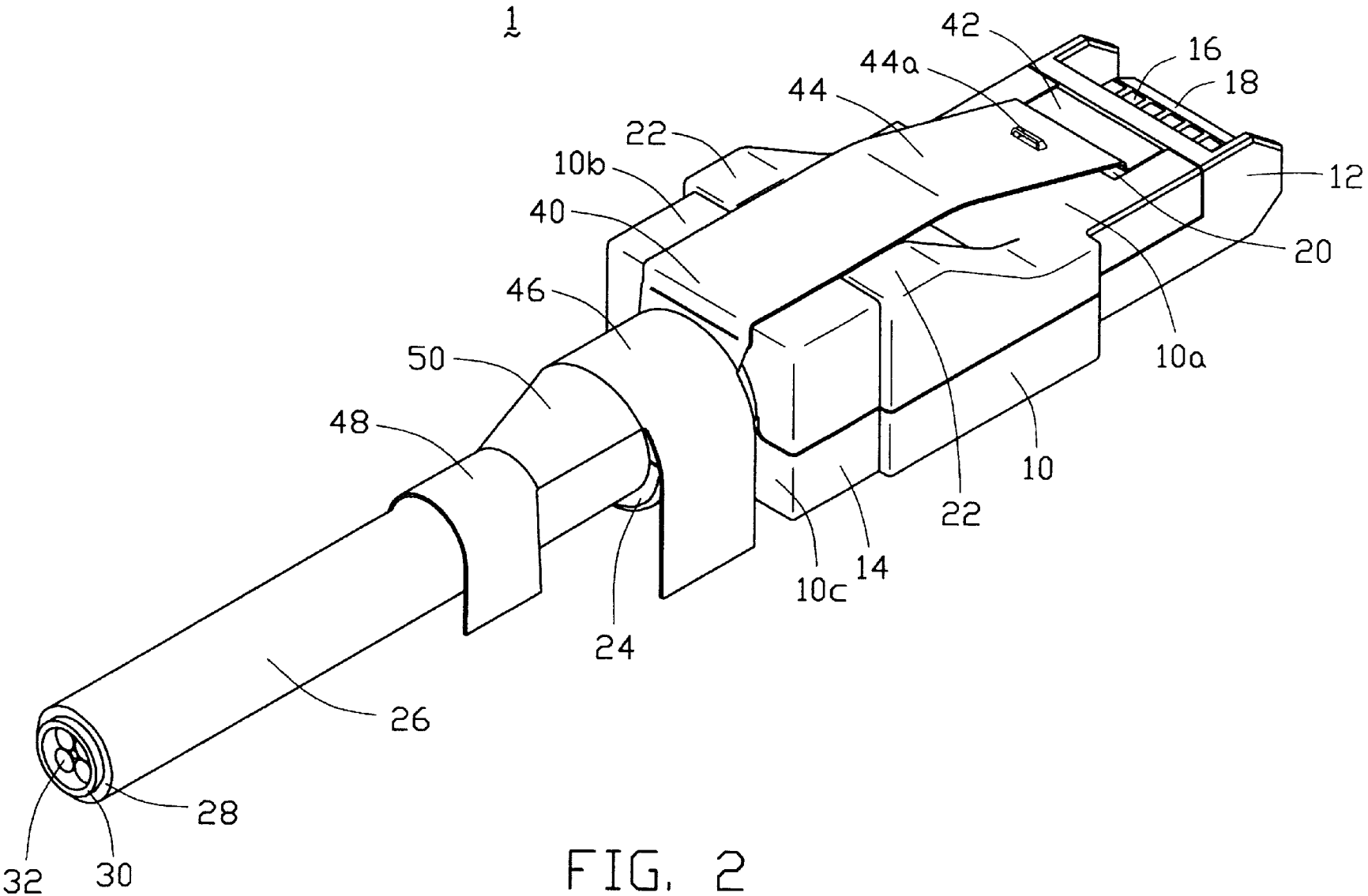
FIG. 2 is a semi-assembled view of FIG. 1.
Figure 3:
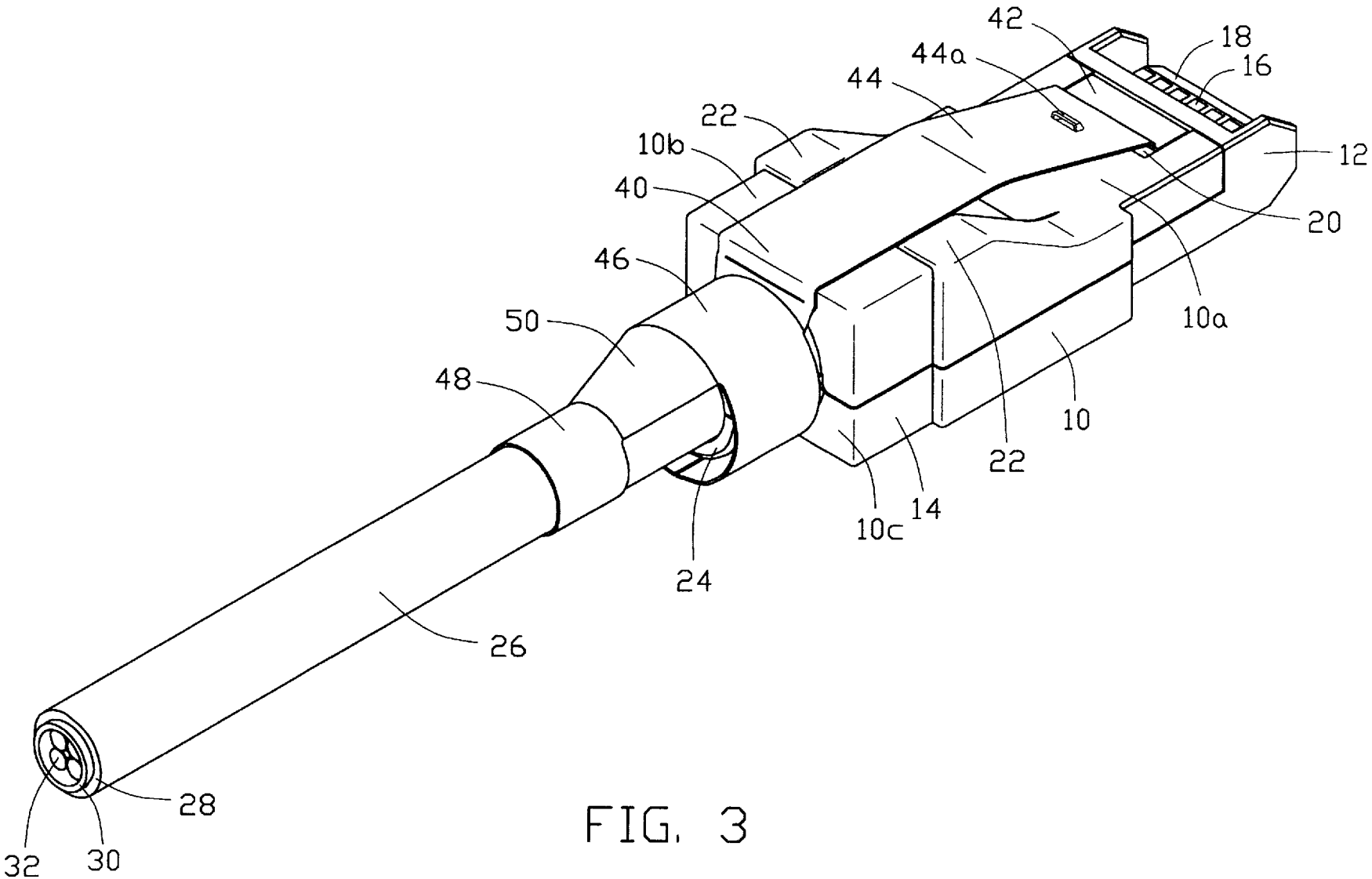
FIG. 3 is a fully assembled view of FIG. 1.

Referring to FIGS. 1 to 3, a high speed serial data connector (HSSDC) 1 includes an insulating housing 10 having a first end 12 and a second end 14 opposite the first end 12. A plurality of electrical mating portions 16 is located in an insulator 18 which is exposed out of the first end 12. The first end 12 defines a recess 20 in a first surface 10*a* thereof. The second end 14 is thicker than the first end 12 and defines a pair of spaced blocks 22 at a second surface 10*b* which is parallel to the first surface 10*a*.

A cable 26 has an end secured to the housing 10 and extending through a central portion of a third surface 10*c* of the second end 14 of the housing 10. The cable 26 includes an insulating jacket 24, a metal braiding 28 surrounded by the jacket 24, an insulating layer 30 surrounded by the braiding 28 and a plurality of conductors 32 in the insulating layer 30. The conductors 32 extend in the housing 10 and electrically connect with the mating portions 16, respectively.

A metal piece 34 includes a metal latch 36 and a metal cable strain relief 38 integrally formed with the metal latch 36. The metal latch 36 includes an horizontal portion 40 near the strain relief 38, a flat retaining portion 42 at a distal end thereof and parallel to and downwardly stepped with the horizontal portion 40, and an inclined portion 44 between the horizontal portion 40 and the retaining portion 42. The inclined portion 44 forms a latch tab 44*a* thereon for latching to a grounding piece of a mating connector (not shown). The strain relief 38 includes a first crimping portion 46 near the metal latch 36, a second crimping portion 48 at a distal thereof, and a connect portion 50 between the first and second crimping portions 46 and 48. The first crimping portion 46 crimps around a portion of the jacket 24 adjacent to the third surface 10*c*. The second crimping portion 48 is similar to the first crimping portion 46 but has a smaller diameter to directly crimp the metal braiding 28.

Referring to FIGS. 2 to 3, in assembly, the cable 26 is assembled to the housing 10 (see FIG. 1) with the conductors 32 electrically engaging with the mating portions 16. The metal piece 34 is then downwardly attached on the connector 1. Finally, the first and second crimping portions 46 and 48 of the strain relief 38 are crimped around the jacket 24 and a portion of the metal braiding 28 respectively by an aid of a crimping tool. After crimping, the horizontal portion 40 of the metal latch 36 is retained between the pair of blocks 22 of the second end 14 of the housing 10. The retaining portion 42 of the metal latch 36 is retained within the recess 20 of the first end 12 of the housing 10. The inclined portion 44 of the metal latch 36 is located over the first surface 10*a* of the first end 12 of the housing 10. The first crimping portion 46 crimps around the jacket 24. The second crimping portion 48 crimps around the metal braiding 28. Thus, the metal piece 34 is securely assembled to the connector 10.

A first advantage of the present invention is that the metal strain relief 38 is integrally formed with the metal latch 36 thereby saving the manufacturing and assembling cost.

A second advantage of the present invention is that the connector has a better grounding performance in comparison with the prior art because the grounding path of the present invention starts from the metal braiding 28 of the cable 26 through the metal piece 34 directly to a grounding piece of the mating connector.

It is to be understood, however, that even though numerous characteristics and advantages of the present invention have been set forth in the foregoing description, together with details of the structure and function of the invention, the disclosure is illustrative only, and changes may be made in detail, especially in matters of shape, size, and arrangement of parts within the principles of the invention to the full extent indicated by the broad general meaning of the terms in which the appended claims are expressed.

What is claimed is:

1. A cable connector comprising:

an insulating housing defining a first end and a second end opposite to the first end thereof;

a plurality of electrical mating portions secured at the first end of the housing for electrically connecting with a mating connector;

a cable secured to the housing, extending through the second end and electrically connecting with the electrical mating portions;

a metal latch having an inclined portion located on the housing for latching to the mating connector; and a metal strain relief integrally formed with the metal latch and defining a first crimping portion crimping around a portion of the cable, the strain relief electrically connecting with metal braiding of the cable; wherein the metal latch comprises a horizontal portion between the inclined portion and the strain relief, the second end of the housing defining a pair of spaced blocks thereon, the horizontal portion being retained between the pair of spaced blocks; wherein the metal latch defines at a free end of the inclined portion a retaining portion parallel to the horizontal portion, the first end of the housing defining a recess therein, the retaining portion being retained within the recess wherein the strain relief further comprises a second crimping portion and an inclined connect portion between the first and second crimping portions, the second crimping portion having a diameter smaller than that of the first crimping portion and directly crimping around the metal braiding of the cable.

2. The cable connector as claimed in claim 1, wherein the inclined portion of the metal latch defines a latch tab thereon for latching to the mating connector.

* * * * *